US008062056B2

(12) United States Patent
Lee

(10) Patent No.: US 8,062,056 B2
(45) Date of Patent: Nov. 22, 2011

(54) ELECTRIC WIRE CONNECTOR FOR PRESS CONNECTING ELECTRIC WIRES

(75) Inventor: Younghwan Lee, Gyeonggi-do (KR)

(73) Assignee: Jowoo-Tech Co., Ltd., Seoul (KR)

( * ) Notice: Subject to any disclaimer, the term of this patent is extended or adjusted under 35 U.S.C. 154(b) by 0 days.

(21) Appl. No.: 12/662,058

(22) Filed: Mar. 30, 2010

(65) Prior Publication Data

US 2011/0065306 A1 Mar. 17, 2011

(30) Foreign Application Priority Data

Sep. 17, 2009 (KR) ..... 10-2009-0087864

(51) Int. Cl.
*H01R 4/24* (2006.01)
*H01R 4/26* (2006.01)
*H01R 11/20* (2006.01)

(52) U.S. Cl. ..... 439/395; 439/409

(58) Field of Classification Search ..... 439/395, 439/396, 397, 409, 410, 402, 413, 417, 387, 439/446, 596
See application file for complete search history.

(56) References Cited

U.S. PATENT DOCUMENTS 1,290,153 A * 1/1919 Fitzpatrick ..... 439/410
4,136,920 A * 1/1979 Scholtholt et al. ..... 439/395
4,472,596 A * 9/1984 Brown et al. ..... 174/84 C
4,684,195 A * 8/1987 Anderson et al. ..... 439/404
4,722,699 A * 2/1988 Heng et al. ..... 439/396
6,254,421 B1 * 7/2001 Denovich et al. ..... 439/409
6,716,055 B1 * 4/2004 Echito ..... 439/417
6,769,931 B2 * 8/2004 Negishi et al. ..... 439/404
7,442,067 B1 * 10/2008 Amaral ..... 439/369
7,867,013 B2 * 1/2011 Cox et al. ..... 439/404
7,887,360 B2 * 2/2011 Andrade ..... 439/369

* cited by examiner

*Primary Examiner* — Hae Moon Hyeon
(74) *Attorney, Agent, or Firm* — Bacon & Thomas, PLLC

(57) ABSTRACT

An electric wire connector is disclosed. The electric wire connector includes an insulative lower connector formed in a shape extending in a first direction, the lower connector being open at a top thereof, the lower connector being provided at sides thereof with a plurality of fixing protrusions and shaft openings, an insulative upper connector formed in a shape extending in the first direction, the upper connector being open at a bottom thereof, the upper connector being provided at sides thereof with fixing holes into which the fixing protrusions of the lower connector are inserted and a fixing shaft inserted through the shaft openings of the lower connector, and a conductive member disposed in the lower connector, the conductive member having a plurality of cutting blades for peeling off sheaths of electric wires, the cutting blades being electrically connected to cores of the electric wires.

1 Claim, 12 Drawing Sheets

ELECTRIC WIRE CONNECTOR FOR PRESS CONNECTING ELECTRIC WIRES

BACKGROUND OF THE INVENTION

1. Field of the Invention

The present invention relates to an electric wire connector, and, more particularly, to an electric wire connector that is capable of connecting electric wires to each other without peeling off sheaths of the respective electric wires.

2. Description of the Related Art

Connection between two or more separate electric wires may be achieved using a method of peeling sheaths of the electric wires, connecting exposed cores of the electric wires, and wrapping the connected cores with an insulating tape.

In the method using insulating tape, however, a tool for twisting the cores of the electric wires is needed. Furthermore, the connection operation is complicated and troublesome. In addition, safety against electric shock is not guaranteed.

SUMMARY OF THE INVENTION

Therefore, the present invention has been made in view of the above problems, and it is an object of the present invention to provide an electric wire connector that is capable of rapidly and easily connecting a plurality of electric wires to each other without using a special tool and without peeling off sheaths of the respective electric wires.

In accordance with an aspect of the present invention, the above and other objects can be accomplished by the provision of an electric wire connector including an insulative lower connector formed in a shape extending in a first direction, the lower connector being open at a top thereof, the lower connector being provided at sides thereof with a plurality of fixing protrusions and shaft openings, an insulative upper connector formed in a shape extending in the first direction, the upper connector being open at a bottom thereof, the upper connector being provided at sides thereof with fixing holes into which the fixing protrusions of the lower connector are inserted and a fixing shaft inserted through the shaft openings of the lower connector, and a conductive member disposed in the lower connector, the conductive member having a plurality of cutting blades for peeling off sheaths of electric wires, the cutting blades being electrically connected to cores of the electric wires.

In accordance with another aspect of the present invention, there is provided an electric wire connector including an insulative lower connector formed in a shape extending in a first direction, the lower connector being open at a top thereof, the lower connector being provided at sides thereof with a plurality of fixing holes, an insulative upper connector formed in a shape extending in the first direction, the upper connector being open at a bottom thereof, the upper connector being provided at an inside thereof with a plurality of guide hole parts protruding downward such that electric wires are inserted through the guide hole parts, the upper connector covering the lower connector, a plurality of fixing pieces disposed on the upper connector for fixedly pressing the upper connector through coupling between the fixing holes of the lower connector and fixing cores, and a conductive member disposed in the lower connector, the conductive member having a plurality of cutting blades for peeling off sheaths of the electric wires, the cutting blades being electrically connected to cores of the electric wires.

In accordance with a further aspect of the present invention, there is provided an electric wire connector including an insulative lower connector formed in a shape extending in a first direction, the lower connector being open at a top thereof, the lower connector being provided at a bottom thereof with a plurality of fixing protrusions protruding upward, the lower connector being provided at sides thereof with shaft support parts, the lower connector being provided at front and rear ends thereof in a longitudinal direction thereof with support grooves through which electric wires are inserted, the electric wires being supported by the support grooves, an insulative upper connector formed in a shape extending in the first direction, the upper connector being open at a bottom thereof, the upper connector being provided at sides thereof with fixing holes into which the fixing protrusions of the lower connector are inserted and a fixing shaft inserted through the shaft support parts of the lower connector, the upper connector being provided at front and rear ends thereof in a longitudinal direction thereof with support grooves through which electric wires are inserted, the electric wires being supported by the support grooves, the upper connector covering the lower connector, and a conductive member disposed in the lower connector, the conductive member having a plurality of cutting blades for peeling off sheaths of the electric wires, the cutting blades being electrically connected to cores of the electric wires.

The electric wire connector may include a first region and a second region divided about the fixing shaft, the fixing protrusions, the fixing holes, and the guide hole parts may be located in the first region, one of the electric wires being inserted into the first region in the first direction, the support grooves may be located at the sides of the upper connector and the lower connector in the second region, the other electric wire being inserted into the second region through the support grooves in a second direction perpendicular to the first direction, and the cutting blades may protrude from sides of the conductive member.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
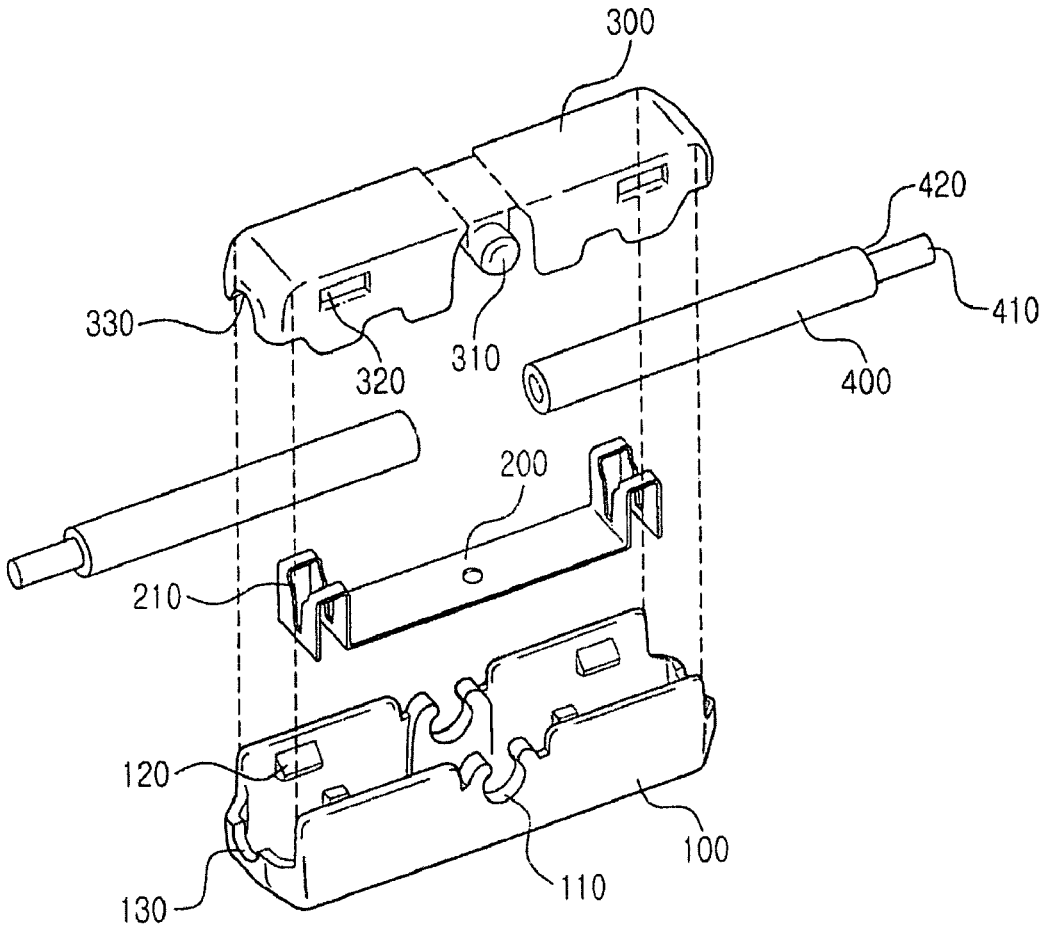
FIG. 1 is an exploded view illustrating an electric wire connector according to a first embodiment of the present invention.

Now, preferred embodiments of the present invention will be described in detail with reference to the accompanying drawings such that the embodiments can be easily implemented by a person having ordinary skill in the art to which the invention pertains. However, the present invention may be implemented in various different forms, and therefore, the present invention is not limited to embodiments which will be described hereinafter. Also, parts having no connection with the present invention will be omitted from the drawings in order to more clearly describe the prevent invention, and similar reference numerals will be used throughout the specification to refer to similar parts.

Throughout the specification, when it is said that a certain part "includes" a certain element, this means that the part may further include other elements, not excluding them, unless otherwise mentioned.

An electric wire connector according to the present invention is formed by assembling an upper connector, a lower connector, and a conductive member disposed between the upper connector and the lower connector, and is configured in a structure to connect separate sheathed electric wires to each other without peeling off sheaths of the respective electric wires.

Hereinafter, an electric wire connector according to a first embodiment of the present invention will be described in detail with reference to FIGS. 1 to 4.

Figure 2:
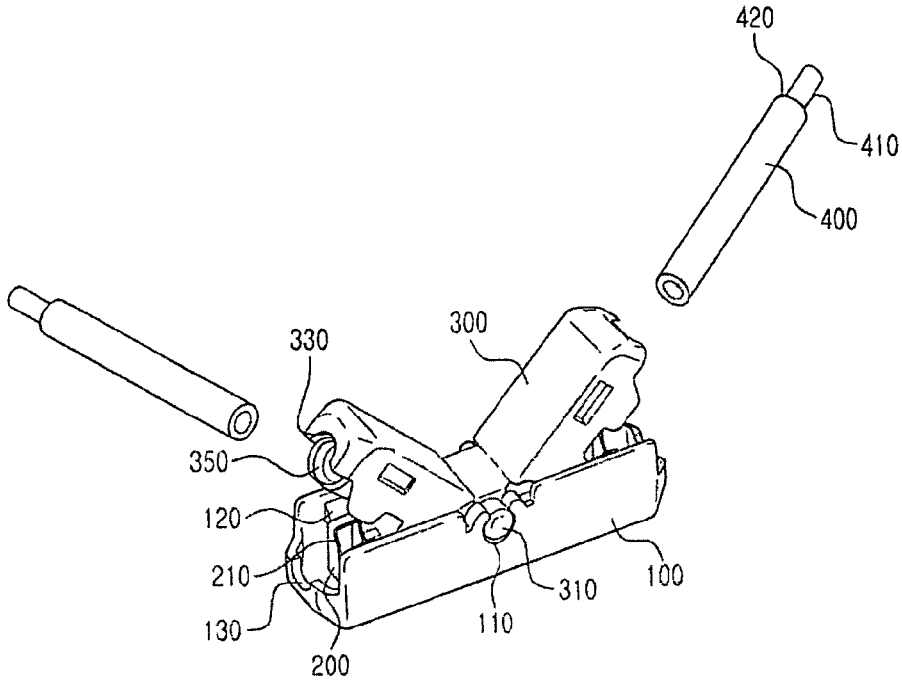
FIG. 2 is a construction view of the electric wire connector shown in FIG. 1 before electric wires are inserted into the electric wire connector.
Figure 3:
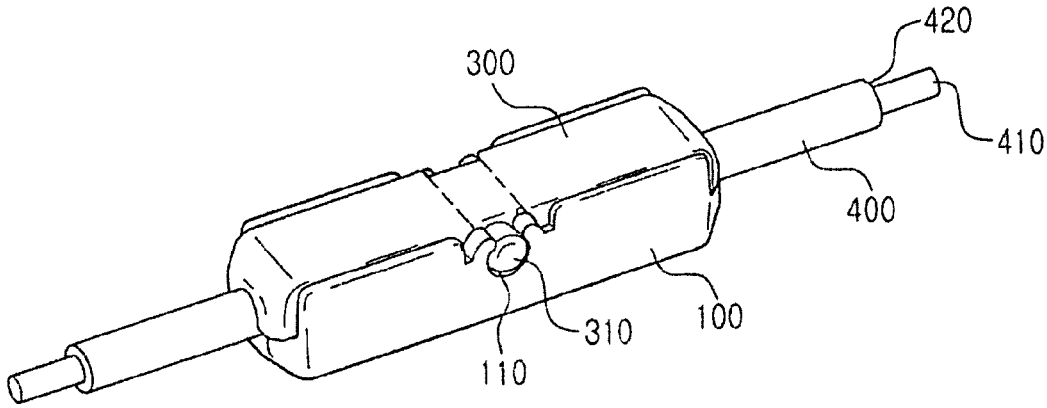
FIG. 3 is a construction view of the electric wire connector shown in FIG. 1 after electric wires are inserted into the electric wire connector.
Figure 4:
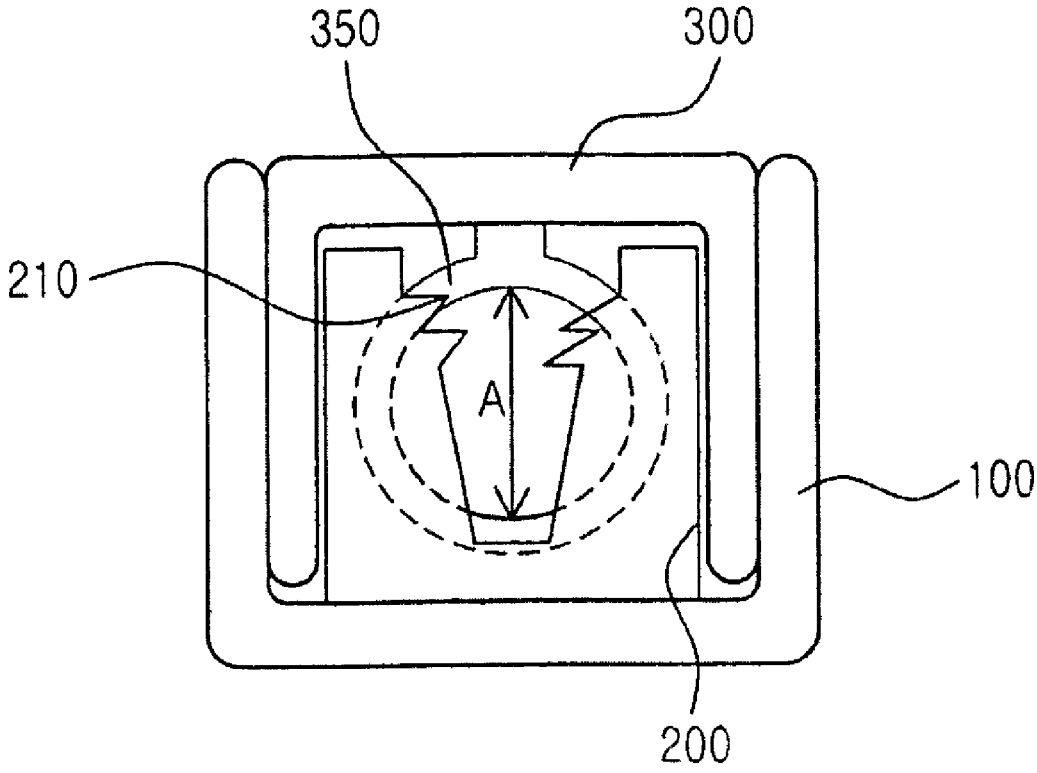
FIG. 4 is a sectional view of the electric wire connector shown in FIG. 3.

FIG. 1 is an exploded view illustrating an electric wire connector according to a first embodiment of the present invention, FIG. 2 is a construction view of the electric wire connector shown in FIG. 1 before electric wires are inserted into the electric wire connector, FIG. 3 is a construction view of the electric wire connector shown in FIG. 1 after electric wires are inserted into the electric wire connector, and FIG. 4 is a sectional view of the electric wire connector shown in FIG. 3.

Referring to FIGS. 1 to 4, the electric wire connector according to the first embodiment of the present invention includes a lower connector 100, an upper connector 300, and a conductive member 200.

The lower connector 100 is a receiving body which is open at the top thereof. The lower connector 100 is formed in a shape extending in the longitudinal direction thereof. The lower connector 100 has a space for receiving the conductive member 200 and electric wires 400 therein.

The lower connector 100 is provided at the front and rear thereof with hemispheric support grooves 130 for supporting the respective electric wires 400. The lower connector 100 has two sides opposite to each other between the front and rear thereof.

At the two sides of the lower connector 100 are formed pluralities of fixing protrusions 120 protruding inward. The fixing protrusions 120 located at one side of the lower connector 100 are opposite to the fixing protrusions 120 located at the other side of the lower connector 100. For example, as shown in FIG. 1, four fixing protrusions 120 may be formed.

Meanwhile, shaft openings 110 are formed at the two sides of the lower connector 100 such that the shaft openings 110 are opposite to each other.

Each of the shaft openings 110 is formed in the shape of a circle which is open at the top thereof. A fixing shaft 310 of the upper connector 300 is fitted into the shaft openings 110 of the lower connector 100 to achieve coupling between the upper connector 300 and the lower connector 100.

At the sides and bottom of the lower connector 100 may be formed pluralities of protrusions for fixing the conductive member 200. The number and shape of the protrusions may be decided based on the shape of the conductive member 200.

The conductive member 200 is provided at each end thereof with a bent plane. A double cutting blade 210 is formed at the bent plane. A plurality of bent planes may be formed at each end of the conductive member 200. In this case, the double cutting blades 210 may be formed at each of the bent planes, thereby providing at least two cutting blades 210.

As shown in FIG. 4, each of the cutting blades 210 has two cutting planes opposite to each other. The two cutting planes are formed such that the distance between the two cutting planes is gradually decreased downward (the distance between the two cutting planes may be uniform). Cutting protrusions are formed at the surface of each of the cutting planes. Specifically, as shown in FIG. 4, the cutting protrusions of one cutting plane are formed in the opposite direction to the cutting protrusions of the other cutting plane.

The conductive member 200 is made of a conductive material, such as metal. For example, the conductive member 200 may be made of a copper alloy, such as phosphor bronze, exhibiting high strength and low denaturalization.

The conductive member 200 may have a predetermined thickness based on critical resistance of electric wires 400 to be coupled to the conductive member 200. Also, the conductive member 200 may include depressions (not shown) to which the protrusions of the lower connector 100 are coupled.

Meanwhile, the upper connector 300 is a receiving body which is open at the bottom thereof. The upper connector 300 is formed in a shape extending in the longitudinal direction thereof. The upper connector 300 covers the lower connector 100 in which the conductive member 200 and the electric wires 400 are received.

The upper connector 300 is provided at the front and rear thereof with hemispheric support grooves 330 for supporting the respective electric wires 400. The upper connector 300 has two sides opposite to each other between the front and rear thereof.

At the two sides of the upper connector 300 are formed pluralities of fixing holes 320 corresponding to the fixing protrusions 120 of the lower connector 100. Also, the upper connector 300 has a cylindrical fixing shaft 310, which is fitted in the shaft openings 110 of the lower connector 100.

The upper connector 300 is symmetric about the fixing shaft 310. The upper connector 300 has thin folding lines (indicated by dotted lines) by which the electric wire connector is opened such that the electric wires 400 can be inserted into the electric wire connector in a state in which the upper connector 300 is coupled to the lower connector 100 as shown in FIG. 2.

Also, a plurality of guide hole parts 350 are formed at the inside top of the upper connector 300.

As shown in FIGS. 2 and 4, the guide hole parts 350 protrude such that the guide hole parts 350 are aligned with the cutting blades 210 of the conductive member 200. Specifically, one or more guide hole parts 350 are formed at least one of the regions of the upper connector 300 divided about the fixing shaft 310.

The guide hole parts 350 protrude from the top of the upper connector 300 toward the lower connector 100. The guide hole parts 350 have a larger diameter A than that of the electric wires 400 such that the electric wires 400, inserted through the support grooves 330 and 130 of the upper and lower connectors 300 and 100, can be inserted through the guide hole parts 350.

The upper connector 300 and the lower connector 100 may be made of a plastic material exhibiting high elasticity to achieve coupling between the upper connector 300 and the lower connector 100 through coupling between the fixing protrusions 120 and the fixing holes 320 and coupling between the fixing shaft 310 and the shaft openings 110.

In this embodiment, the electric wire connector connects the two electric wires 400 in an "I" shape. The electric wire connector is symmetric about the fixing shaft 310.

The electric wire connector is assembled as follows. First, as shown in FIG. 2, the conductive member 200 is placed in the lower connector 100.

The assembly of the lower connector 100 and the conductive member 200 is achieved by coupling the protrusions of the lower connector 100 to the depressions of the conductive member 200. The upper connector 300 is coupled to the lower connector 100 in which the conductive member 200 is disposed.

The assembly of the upper connector 300 and the lower connector 100 is achieved as follows. The fixing shaft 310 of the upper connector 300 is placed above the shaft openings 110 of the lower connector 100, and then the upper connector 300 is pushed downward, with the result that the shaft openings 110 of the lower connector 100 are widened, and therefore, the fixing shaft 310 of the upper connector 300 is securely fitted into the shaft openings 110 of the lower connector 100.

When the opposite ends of the upper connector 300 are lifted upward about the folding lines of the upper connector 300 in this state, the inside top of the upper connector 300 is exposed as shown in FIG. 2.

In this state, two electric wires 400 are inserted into the electric wire connector such that the electric wires 400 are inserted through the exposed guide hole parts 350 located at the opposite ends of the upper connector 300.

After insertion of the electric wires 400 through the exposed guide hole parts 350, downward pressure is applied to the opposite ends of the upper connector 300, as shown in FIG. 3, to achieve coupling between the upper connector 300 and the lower connector 100.

At this time, the fixing protrusions 120 of the lower connector 100 are coupled to the fixing holes 320 of the upper connector 300 to maintain the coupling between the upper connector 300 and the lower connector 100.

Upon completion of the coupling between the upper connector 300 and the lower connector 100, as shown in FIG. 4, the guide hole parts 350 of the upper connector 300 are aligned with the cutting blades 210 of the conductive member 200. As a result, sheaths 420 of the electric wires 400 inserted through the guide hole parts 350 are removed by the cutting blades 210, and the cutting blades 210 penetrate into cores 410 of the electric wires 400 by a predetermined depth.

Consequently, one of the electric wires 400 and the other of the electric wires 400 are electrically connected to each other via the cutting blades 210, and, in addition, the electric wires 400 are securely fixed to the electric wire connector by the cutting blades 210.

At this time, the diameter of the sheathed electric wires 400 satisfies a predetermined range less than the diameter A of the guide hole parts 350.

As can be seen from the above description, the electric wire connector shown in FIGS. 1 to 4 is an "I" type electric wire connector. When the upper connector 300 is pushed downward such that the upper connector 300 is coupled to the lower connector 100 in a state in which the two electric wires 400 are inserted through the guide hole parts 350 located at the opposite ends of the upper connector 300, the electric wires 400 are moved downward, and the sheaths 420 of the respective electric wires 400 are peeled off by the cutting blades 210. In addition, the respective electric wires 400 are securely fixed to the electric wire connector by the cutting blades 210.

Hereinafter, an electric wire connector according to a second embodiment of the present invention will be described in detail with reference to FIGS. 5 and 6.

Figure 5:
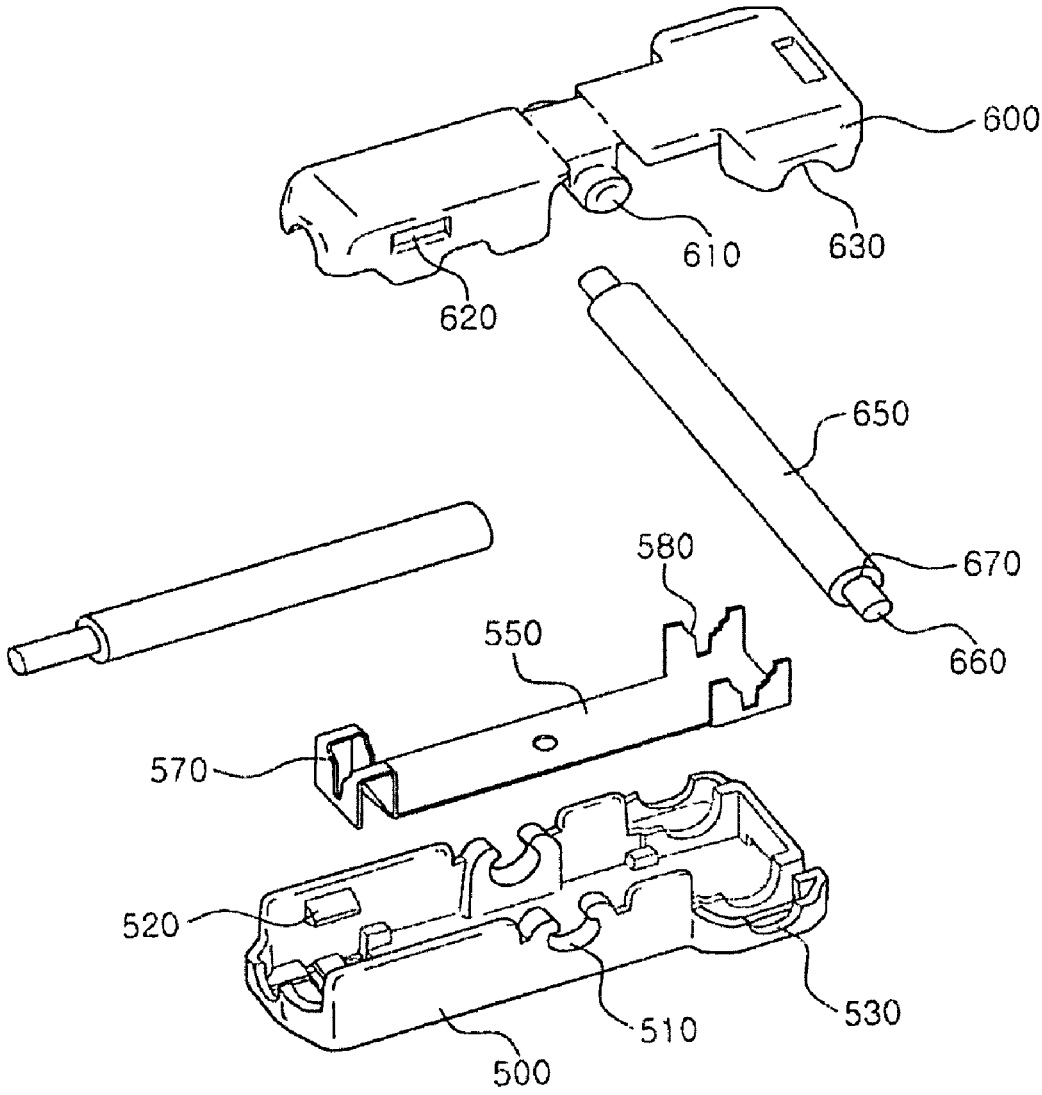
FIG. 5 is an exploded view illustrating an electric wire connector according to a second embodiment of the present invention.
Figure 6:
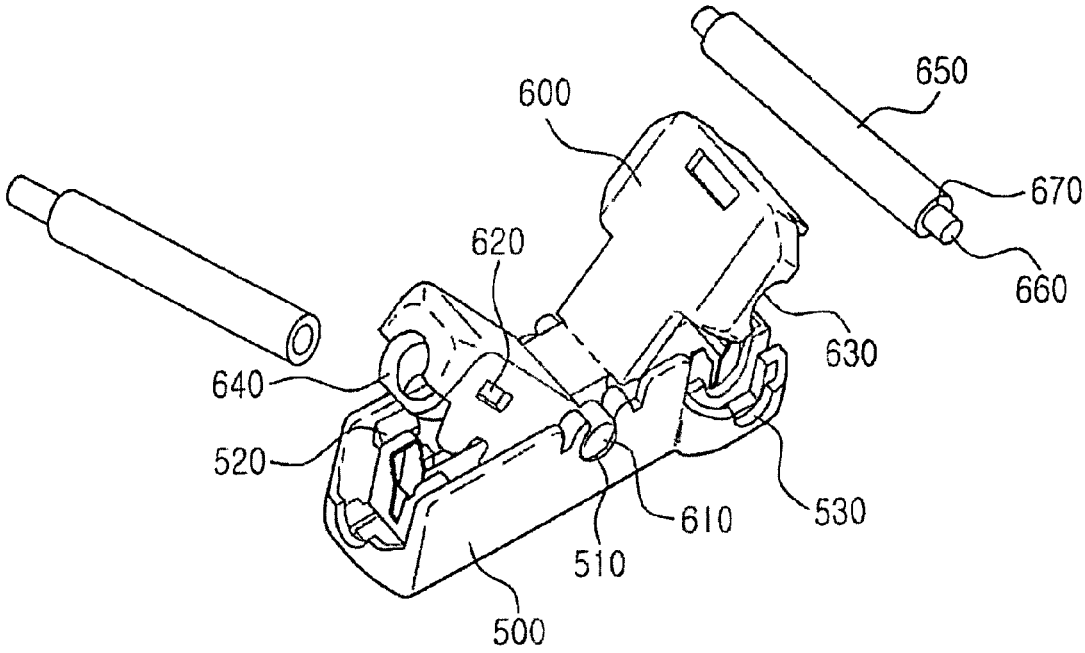
FIG. 6 is a coupled view of the electric wire connector shown in FIG. 5.

FIG. 5 is an exploded view illustrating an electric wire connector according to a second embodiment of the present invention, and FIG. 6 is a coupled view of the electric wire connector shown in FIG. 5.

Referring to FIGS. 5 and 6, the electric wire connector according to the second embodiment of the present invention is used to connect two electric wires 650 to each other in a "T" shape. Specifically, the electric wire connector electrically connects a first electric wire 650 extending in one direction and a second electric wire 650 extending in the direction perpendicular to the first electric wire 650 to each other.

In the same manner as the first embodiment, the "T" type electric wire connector includes a lower connector 500, a conductive member 550, and an upper connector 600. The structure of one side of the "T" type electric wire connector at which the first electric wire 650 is disposed is identical to that of the "I" type electric wire connector as shown in FIGS. 1 to 4, and therefore, a detailed description thereof will not be given.

The lower connector 500 is provided at opposite sides thereof adjacent to one end thereof where the second electric wire 650 is disposed perpendicularly to the first electric wire 650 with support grooves 530 having the same shape as a support groove formed at the front of the lower connector 500 unlike FIG. 1. The conductive member 550 has cutting blades 580 protruding from sides thereof.

Also, the upper connector 600 is provided at opposite sides thereof adjacent to one end thereof with support grooves 630 corresponding to the support grooves 530 of the lower connector 500. A pressing member (not shown) may be formed at the inner top of the upper connector 600.

The "T" type electric wire connector is assembled as shown in FIG. 6. The opposite ends of the upper connector 600 are lifted upward about folding lines (indicated by dotted lines) of the upper connector 600, and then the first and second electric wires 650 are inserted into the upper connector 600.

At this time, the first electric wire 650 is inserted through guide hole part 640 of the upper connector 600 in the same manner as the first embodiment. The second electric wire 650 is placed above the support grooves 530 of the lower connector 500, and the upper connector 600 is pushed downward. As a result, sheaths 670 of the first and second electric wires 650 are peeled off by the cutting blades 570 and 580, and the cutting blades 570 and 580 penetrate into cores 660 of the electric wires 650 by a predetermined depth, thereby achieving electrical connection between the first and second electric wires 650 via the conductive member 550.

As can be seen from the above description, the cutting blades 580 are formed at the opposite sides of the conductive member 550 adjacent to one end of the conductive member 550, and the support grooves 630 and 503 are formed at the opposite sides of the upper and lower connectors 600 and 500 adjacent to one end of each of the upper and lower connectors 600 and 500, thereby achieving "T" type connection between the electric wires 650.

Hereinafter, an electric wire connector according to a third embodiment of the present invention will be described in detail with reference to FIGS. 7 to 9.

Figure 7:
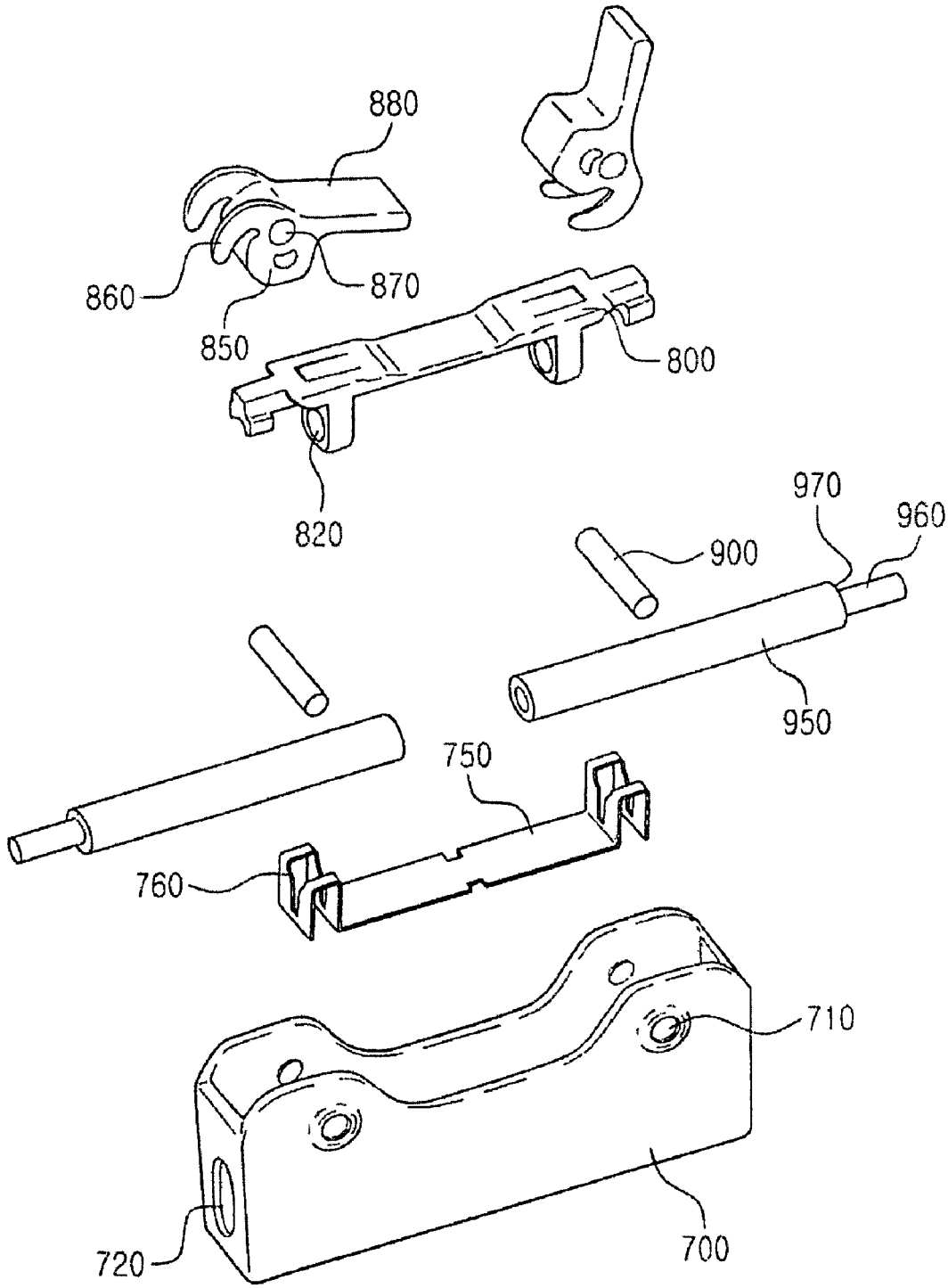
FIG. 7 is an exploded view illustrating an electric wire connector according to a third embodiment of the present invention.

FIG. 7 is an exploded view illustrating an electric wire connector according to a third embodiment of the present invention. FIGS. 8 and 9 are coupled views of the electric wire connector shown in FIG. 7.

Referring to FIG. 7, the electric wire connector according to the third embodiment of the present invention includes a lower connector 700, a conductive member 750, an upper connector 800, and two fixing pieces 850.

The lower connector 700 is a receiving body which is open at the top thereof. The lower connector 700 is formed in a shape extending in the longitudinal direction thereof. The lower connector 700 has a space for receiving the conductive member 700 and electric wires 950 therein.

The lower connector 700 is provided at the front and rear thereof with insertion holes 720 through which the electric wires 950 are inserted. Also, the lower connector 700 is provided at opposite sides thereof with rotation holes 710 through which rotation cores 900 are inserted.

The rotation holes 710 formed at the opposite sides of the lower connector 700 correspond to each other. Specifically, two rotation holes 710 are formed at one side of the lower connector 700.

The conductive member 750 is provided at opposite ends thereof with bent planes in the same manner as shown in FIG. 1. A double cutting blade 760 is formed at each of the bent planes. The structure of the cutting blades 760 is identical to that of the cutting blades 210 shown in FIGS. 1 to 4, and a detailed description thereof will not be given.

Meanwhile, the upper connector 800 is formed in a shape extending in the longitudinal direction thereof. The upper connector 800 covers the lower connector 700 in which the conductive member 750 is received.

A plurality of guide hole parts 820 are formed at the inside top of the upper connector 800. The guide hole parts 820 have the same shape as the guide hole parts 350 shown in FIG. 2.

Also, the fixing pieces 850 are equal in shape. Each of the fixing pieces 850 includes a hook 860 extending from a fixing plane 880 thereof.

Between the fixing plane 880 and the hook 860 is formed a rotation hole 870 corresponding to the rotation holes 710 formed at the opposite sides of the lower connector 700.

In this embodiment, the electric wire connector is assembled as follows. As shown in FIG. 8, the conductive member 750 is fixedly inserted into the lower connector 700, the lower connector 700 is covered by the upper connector 800, and the rotation cores 900 are inserted through the rotation holes 870 of the fixing pieces 850 and the rotation holes 710 of the lower connector 700 in a state in which the rotation holes 870 of the fixing pieces 850 are aligned with the rotation holes 710 of the lower connector 700.

At this time, when the fixing planes 880 of the respective fixing pieces 850 on the upper connector 800 are opened upward, coupling between the upper connector 800 and the lower connector 700 is loosened.

When two electric wires 950 are inserted through the insertion holes 720 formed at the opposite ends of the lower connector 700 while the fixing planes 880 are open, the electric wires 950 are inserted through the guide hole parts 820 of the upper connector 800 aligned with the insertion holes 720 of the lower connector 700.

When the insertion of the electric wires 950 is completed, the fixing planes 880 of the respective fixing pieces 850 are pushed downward such that the fixing planes 880 are fixedly located on the upper connector 800.

Figure 9:
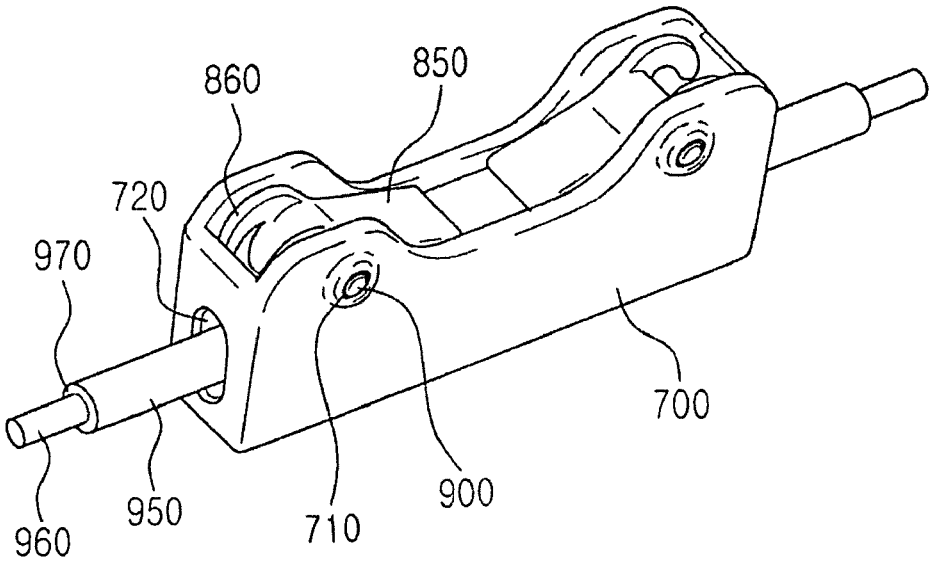

When the fixing planes 880 of the respective fixing pieces 850 are located on the upper connector 800, as shown in FIG. 9, the upper connector 800 is pushed downward by the fixing pieces 850, with the result that the upper connector 800 is securely fixed. In addition, sheaths of the electric wires 950 are peeled off by the cutting blades 760, and electric contact between the electric wires 950 and the cutting blades 760 is maintained.

Figure 8:
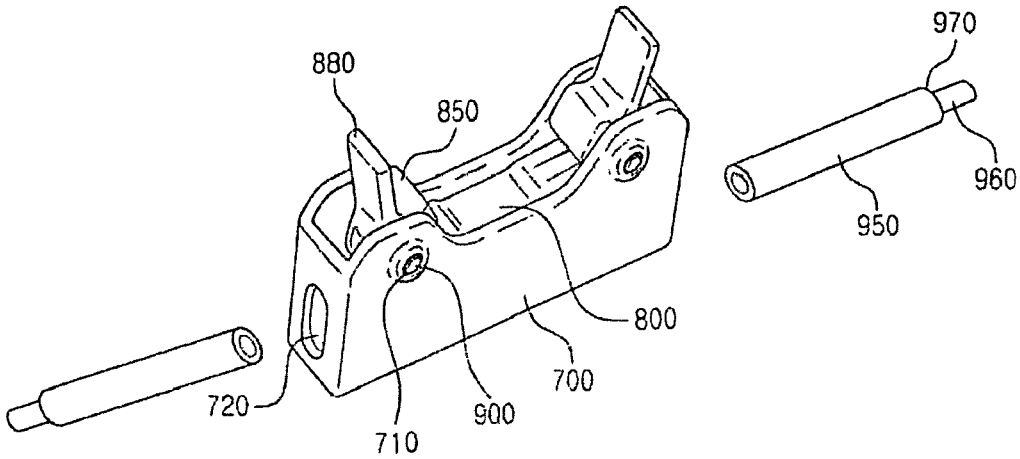
FIGS. 8 and 9 are coupled views of the electric wire connector shown in FIG. 7.

In the electric wire connector according to the third embodiment of the present invention as shown in FIGS. 7 to 9, the two electric wires 950 may be separated from the electric wire connector by opening the fixing pieces 850 in a state in which the electric wires 950 are electrically connected to each other by the electric wire connector. Also, after separation of the electric wires 950 from the electric wire connector, other different electric wires may be connected to each other by the electric wire connector.

Consequently, one end of the electric wire connector according to the third embodiment of the present invention may be connected to an electric wire connected to an electric appliance, for example, one end of an electric wire of an electric appliance such as an electric bulb, an electric heater, or a communication device.

In a case in which the electric wire connector according to the third embodiment of the present invention is connected to one end of an electric wire of an electric appliance, the electric wire connector may be connected to an electric source located adjacent to a region where the electric appliance is installed. When it is necessary to change the position of the electric appliance, the electric wire connector may be disconnected from the electric source which supplies power to the electric appliance, and the electric wire connector may be connected to another electric source located adjacent to a region where the electric appliance will be newly installed.

Figure 10:
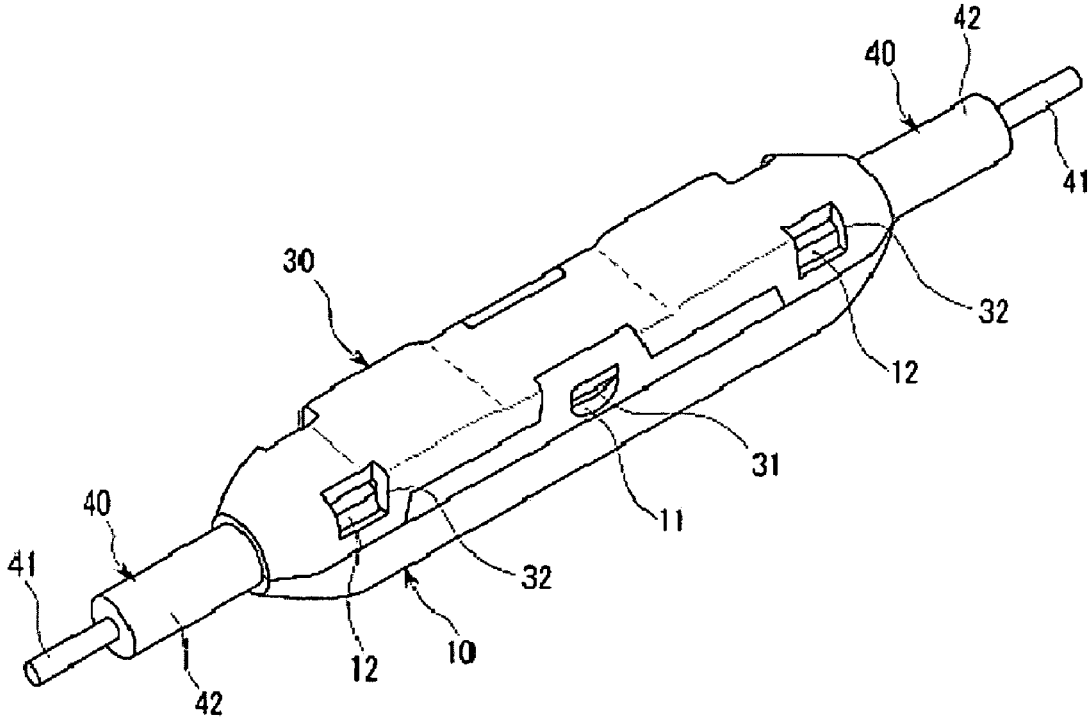
FIG. 10 is a perspective view illustrating an electric wire connector according to a fourth embodiment of the present invention.
Figure 11:
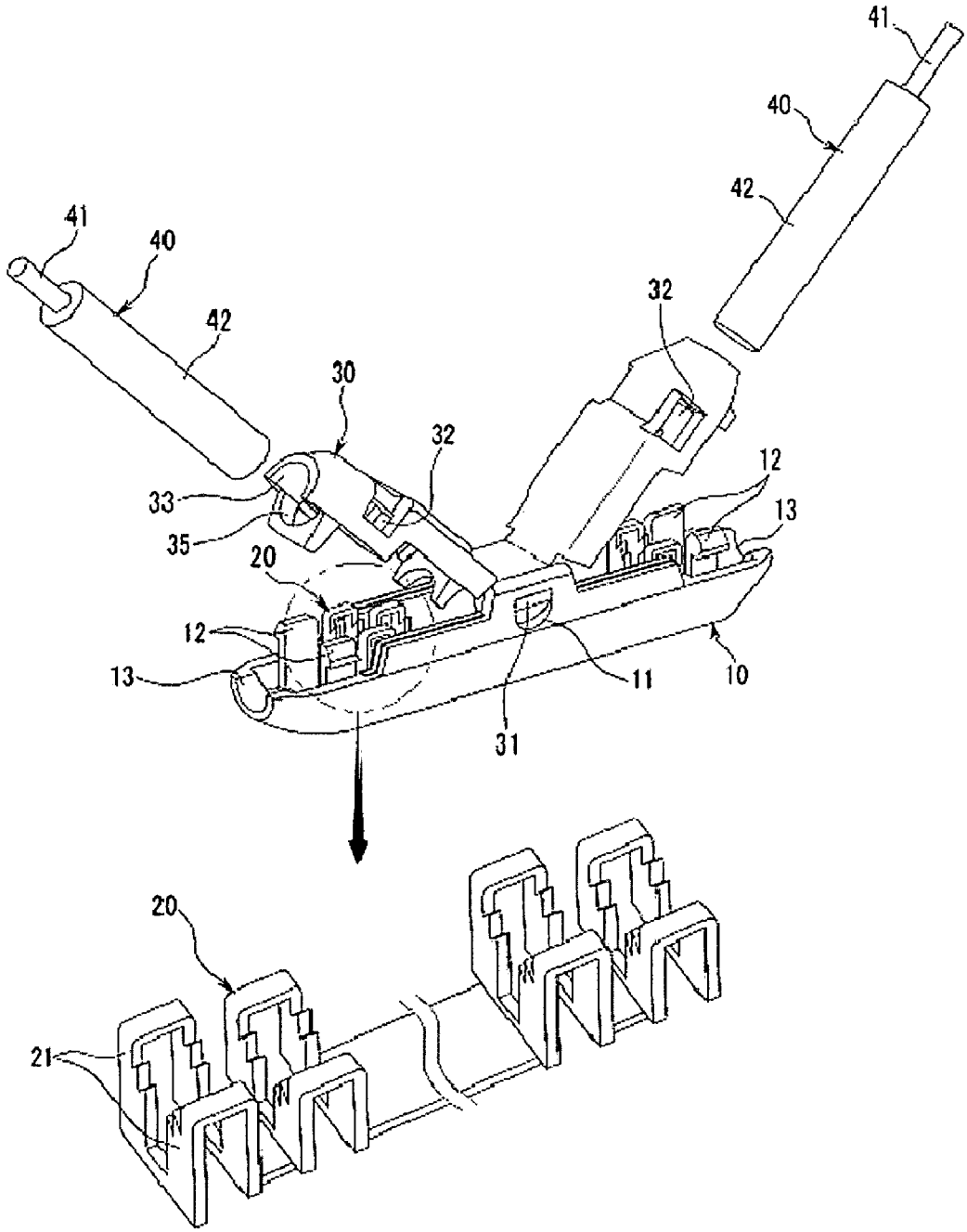
FIG. 11 is a perspective view of the electric wire connector shown in FIG. 10 illustrating a state in which an upper connector of the electric wire connector is open.
Figure 12:
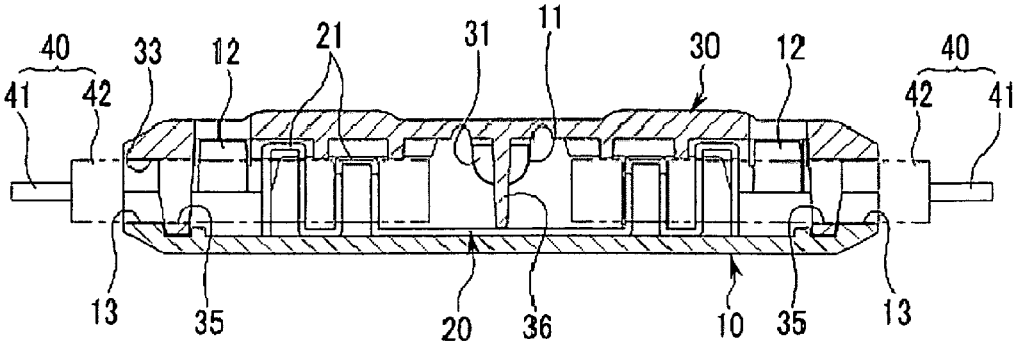
FIG. 12 is a sectional view of the electric wire connector shown in FIG. 10 after electric wires are inserted into the electric wire connector.

Referring to FIGS. 10 to 12, an electric wire connector according to a fourth embodiment of the present invention includes a lower connector 10, an upper connector 30, and a conductive member 20.

The lower connector 10 is a receiving body which is open at the top thereof. The lower connector 10 is formed in a shape extending in the longitudinal direction thereof. The lower connector 10 has a space for receiving the conductive member 20 and electric wires 40 therein.

The lower connector 10 is provided at the front and rear ends thereof in the longitudinal direction thereof with hemispheric support grooves 13 for supporting the respective electric wires 40. The lower connector 100 has two sides opposite to each other between the front and rear ends thereof.

At opposite ends of the bottom of the lower connector 10 in the longitudinal direction thereof are formed pluralities of fixing protrusions 12 protruding upward and then bent outward from the upper ends thereof. The fixing protrusions 12 located at one side of the lower connector 10 are opposite to the fixing protrusions 12 located at the other side of the lower connector 10. For example, as shown in FIG. 11, four fixing protrusions 12 may be formed at the opposite ends of the lower connector 10.

Meanwhile, the lower connector 10 is provided at opposite sides of the middle thereof with shaft support parts 11 facing each other.

The shaft support parts 11 are formed in the shape of through holes formed through the opposite sides of the lower connector 10. A fixing shaft 31 of the upper connector 30 is inserted into the shaft support parts 11, with the result that the upper connector 30 is coupled to the lower connector 10.

The conductive member 20 is provided at each end thereof with a plurality of bent parts bent in the shape of "[". A double cutting blade 21 is formed at each of the bent parts. Meanwhile, the double cutting blades 21 may be formed at each of the bent parts of the conductive member 20, thereby providing at least two cutting blades 21.

Each of the cutting blades 21 has two cutting planes opposite to each other. The two cutting planes are formed such that the distance between the two cutting planes is uniform or gradually decreased downward. Cutting protrusions are formed at the surfaces of the respective cutting planes.

The conductive member 20 is made of a conductive material, such as metal. For example, the conductive member 20 may be made of a copper alloy, such as phosphor bronze, exhibiting high strength and low denaturalization.

The conductive member 20 may have a predetermined thickness based on critical resistance of electric wires 40 to be coupled to the conductive member 20.

Meanwhile, the upper connector 30 is a receiving body which is open at the bottom thereof. The upper connector 30 is formed in a shape extending in the longitudinal direction thereof. The upper connector 30 covers the lower connector 10 in which the conductive member 20 and the electric wires 40 are received.

The upper connector 30 is provided at the front and rear thereof with hemispheric support grooves 33 for supporting the respective electric wires 40. The upper connector 30 has two sides opposite to each other between the front and rear thereof in the longitudinal direction thereof.

At the two sides of the upper connector 30 are formed pluralities of fixing holes 32 into which the fixing protrusions 12 of the lower connector 10 are fixedly inserted. Also, the fixing shaft 31 extends from one side to the other side of the upper connector 30 such that the fixing shaft 31 is fixedly inserted into the shaft support parts 11 of the lower connector 10.

The upper connector 30 is symmetric about the fixing shaft 31. The upper connector 30 has thin folding lines (indicated by dotted lines) by which the electric wire connector is opened such that the electric wires 40 can be inserted into the electric wire connector in a state in which the upper connector 30 is coupled to the lower connector 10.

Also, a plurality of guide hole parts 35 are formed at the inside top of the upper connector 30.

The guide hole parts 35 protrude such that the guide hole parts 35 are aligned with the fixing protrusions 12 of the lower connector 10. Specifically, one or more guide hole parts 35 are formed at least one of the regions of the upper connector 30 divided about the fixing shaft 31.

The guide hole parts 35 have a larger diameter than that of the electric wires 40 such that the electric wires 40, inserted through the support grooves 33 and 13 of the upper and lower connectors 30 and 10, can be inserted through the guide hole parts 35.

The upper connector 30 is provided at the middle of the bottom thereof with a plate-shaped fixing piece 36 protruding downward for pressing the top of the conductive member 20 to fix the conductive member 20. The shape of the fixing piece 36 may be decided based on the shape of the conductive member 20.

The upper connector 30 and the lower connector 10 may be made of a plastic material exhibiting high elasticity to achieve coupling between the upper connector 300 and the lower connector 100 through coupling between the fixing protrusions 12 and the fixing holes 32 and coupling between the fixing shaft 31 and the shaft support parts 11.

In this embodiment, the electric wire connector connects the two electric wires 40 in an "I" shape. The electric wire connector is symmetric about the fixing shaft 31.

The electric wire connector is assembled as follows. First, as shown in FIG. 11, the conductive member 20 is placed in the lower connector 10.

The assembly of the upper connector 30 and the lower connector 10 is achieved by fixedly inserting the fixing shaft 31 of the upper connector 30 into the shaft support parts 11 of the lower connector 10.

At this time, the conductive member 20 is pressed by the fixing piece 36 of the upper connector 30 coupled to the lower connector 10.

When the opposite ends of the upper connector 30 are lifted upward about the folding lines of the upper connector 30 in this state, the inside top of the upper connector 30 is exposed.

In this state, two electric wires 40 are inserted into the electric wire connector such that the electric wires 40 are inserted through the exposed guide hole parts 35 located at the opposite ends of the upper connector 30.

After insertion of the electric wires 40 through the exposed guide hole parts 35, downward pressure is applied to the opposite ends of the upper connector 30 to achieve coupling between the upper connector 30 and the lower connector 10.

At this time, the fixing protrusions 12 of the lower connector 10 are coupled to the fixing holes 32 of the upper connector 30 to maintain the coupling between the upper connector 30 and the lower connector 10.

Upon completion of the coupling between the upper connector 30 and the lower connector 10, the guide hole parts 35 of the upper connector 30 are aligned with the cutting blades 21 of the conductive member 20. As a result, sheaths 42 of the electric wires 40 inserted through the guide hole parts 35 are removed by the cutting blades 21, and the cutting blades 21 penetrate into cores 41 of the electric wires 40 by a predetermined depth.

Consequently, one of the electric wires 40 and the other of the electric wires 40 are electrically connected to each other via the cutting blades 21, and, in addition, the electric wires 40 are securely fixed to the electric wire connector by the cutting blades 21.

At this time, the diameter of the sheathed electric wires 40 satisfies a predetermined range less than the diameter of the guide hole parts 35.

As can be seen from the above description, the electric wire connector shown in FIGS. 10 to 12 is an "I" type electric wire connector. When the upper connector 30 is pushed downward such that the upper connector 30 is coupled to the lower connector 10 in a state in which the two electric wires 40 are inserted through the guide hole parts 35 located at the opposite ends of the upper connector 30, the electric wires 40 are pressed downward, and the sheaths 42 of the respective electric wires 40 are peeled off by the cutting blades 21. In addition, the respective electric wires 40 are securely fixed to the electric wire connector by the cutting blades 21.

Hereinafter, an electric wire connector according to a fifth embodiment of the present invention will be described in detail with reference to FIGS. 13 and 14.

The electric wire connector according to the fifth embodiment of the present invention is used to connect two electric wires 65 to each other in a "T" shape. Specifically, the electric wire connector electrically connects a first electric wire 65 extending in one direction and a second electric wire 65 extending in the direction perpendicular to the first electric wire 65 to each other.

In the same manner as the fourth embodiment, the "T" type electric wire connector includes a lower connector 50, a conductive member 55, and an upper connector 60. The structure of one side of the "T" type electric wire connector at which the first electric wire 65 is disposed is identical to that of the "I" type electric wire connector as shown in FIGS. 10 to 12, and therefore, a detailed description thereof will not be given.

The lower connector 50 is provided at opposite sides thereof adjacent to one end thereof where the second electric wire 65 is disposed perpendicularly to the first electric wire 65 with support grooves 53 having the same shape as a support groove formed at the front of the lower connector 50 unlike FIG. 10. The conductive member 55 has cutting blades 58 protruding from sides thereof.

Also, the upper connector 60 is provided at opposite sides thereof adjacent to one end thereof with support grooves 63 corresponding to the support grooves 53 of the lower connector 50. A pressing member (not shown) may be formed at the inner top of the upper connector 60.

Figure 13:
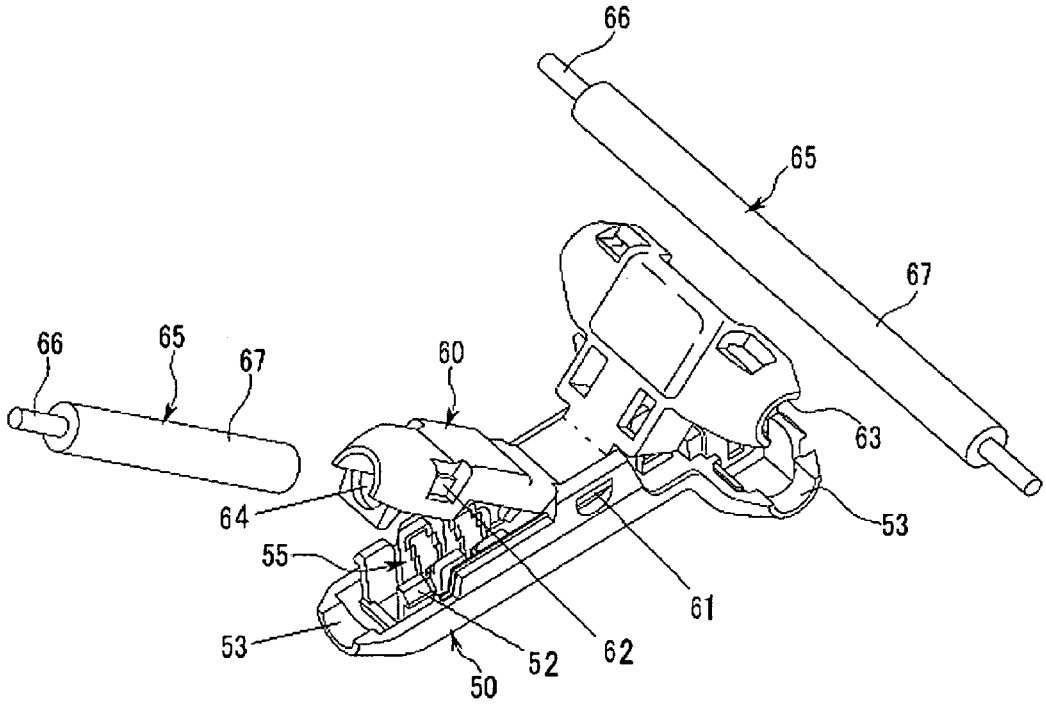
FIG. 13 is a perspective view illustrating an electric wire connector according to a fifth embodiment of the present invention.
Figure 14:
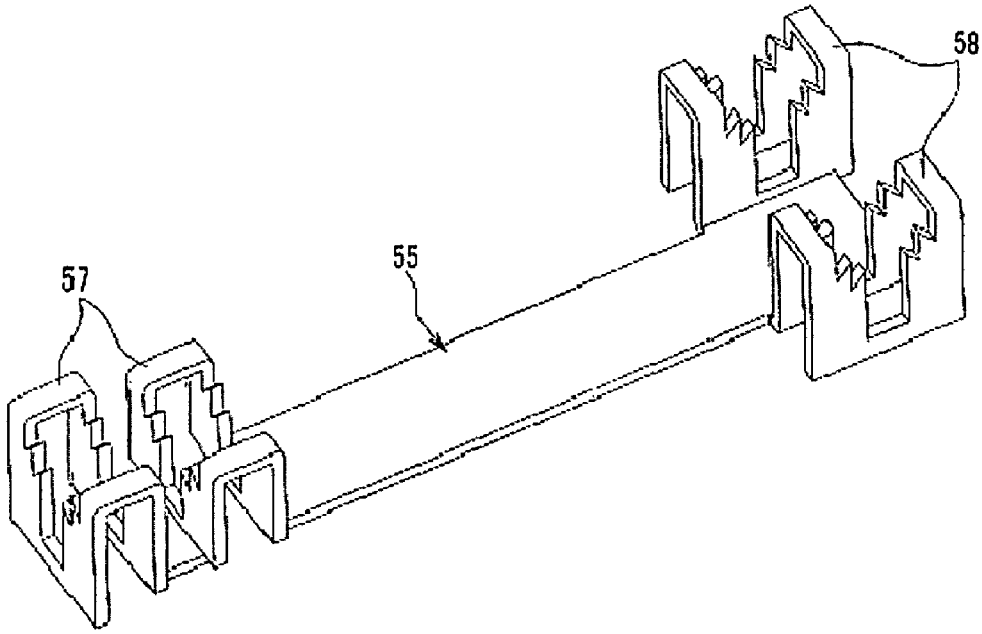
FIG. 14 is a perspective view illustrating a conductive member of the electric wire connector shown in FIG. 13.

The "T" type electric wire connector is assembled as shown in FIG. 13. The opposite ends of the upper connector 60 are lifted upward about folding lines (indicated by dotted lines in FIG. 13) of the upper connector 60, and then the first and second electric wires 65 are inserted into the upper connector 60.

At this time, the first electric wire 65 is inserted through guide hole part 64 of the upper connector 60 in the same manner as the fourth embodiment. The second electric wire 65 is placed above the support grooves 53 of the lower connector 50, and the upper connector 60 is pushed downward. As a result, sheaths 67 of the first and second electric wires 65 are peeled off by the cutting blades 57 and 58, and the cutting blades 57 and 58 penetrate into cores 66 of the electric wires 65 by a predetermined depth, thereby achieving electrical connection between the first and second electric wires 65 via the conductive member 55.

As can be seen from the above description, the cutting blades 58 are formed at the opposite sides of the conductive member 55 adjacent to one end of the conductive member 55, and the support grooves 63 and 50 are formed at the opposite sides of the upper and lower connectors 60 and 50 adjacent to one end of each of the upper and lower connectors 60 and 50, thereby achieving "T" type connection between the electric wires 650.

Figure 15:
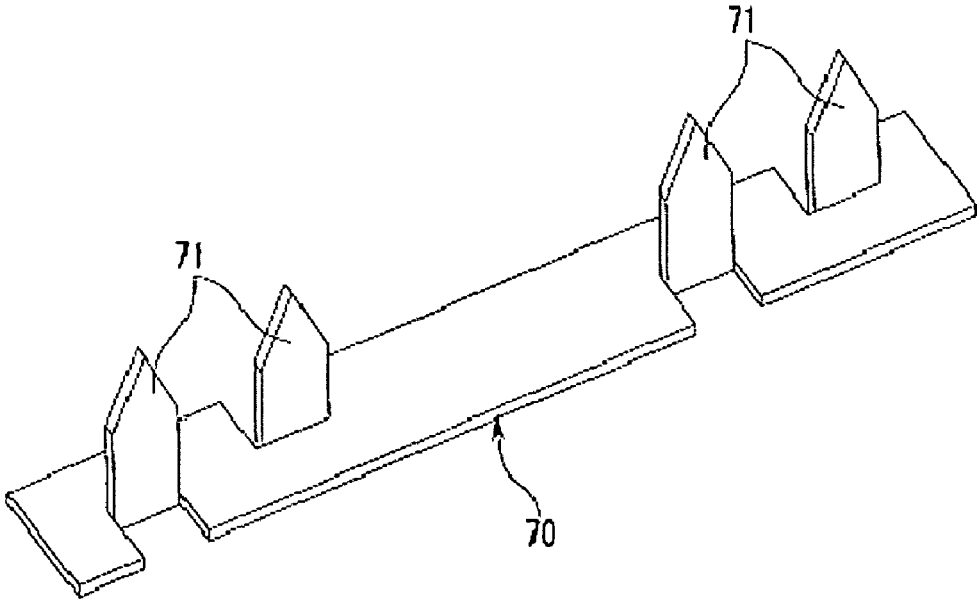
FIG. 15 is a perspective view illustrating another embodiment of the conductive member according to the present invention.
Figure 16:
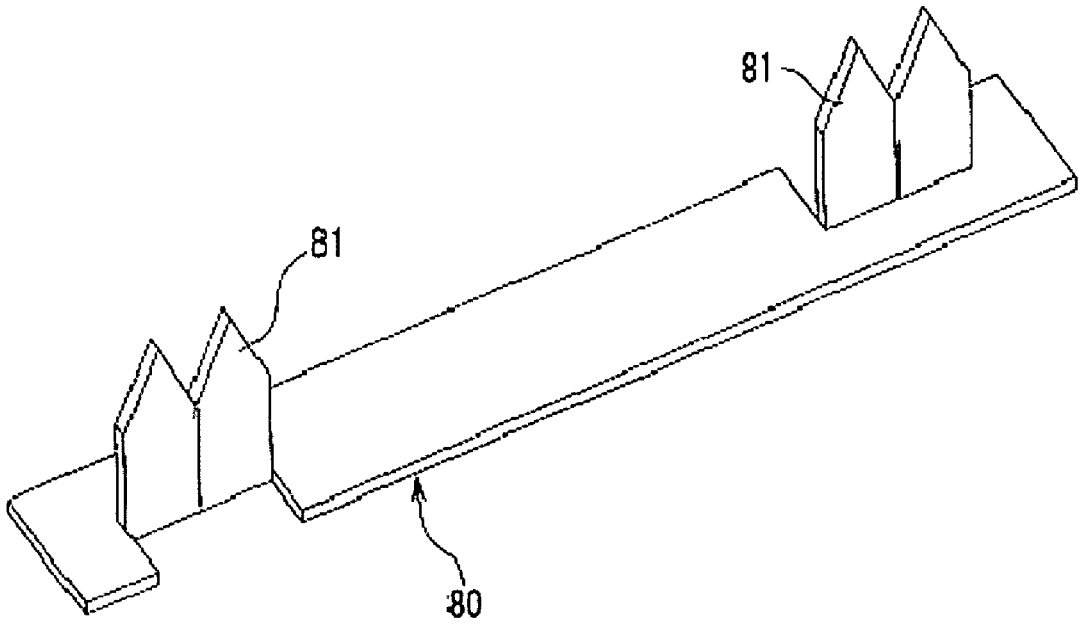
FIG. 16 is a perspective view illustrating a further embodiment of the conductive member according to the present invention.

Meanwhile, FIGS. 15 and 16 illustrate conductive members 70 and 80 according to other embodiments of the present invention, respectively. The conductive members 70 and 80 are configured in structures in which pluralities of pin-shaped cutting blades 71 and 81 are formed at strip-shaped plates such that the pin-shaped cutting blades 71 and 81 protrude sharp from opposite sides of the strip-shaped plates, the portions of the strip-shaped plates corresponding to the pin-shaped cutting blades 71 and 81 are cut to predetermined widths of the strip-shaped plates, and the pin-shaped cutting blades 71 and 81 are bent upward.

When electric wires are connected to the conductive members 70 and 80, the cutting blades 71 and 81 penetrate the centers of the electric wires such that the electric wires are electrically connected to each other via the conductive members 70 and 80.

As shown in FIG. 15, the cutting blades 71 may be arranged at regular intervals in the longitudinal direction of the conductive member 70. As shown in FIG. 16, the cutting blades 81 may be arranged in pairs such that the cutting blades 81 are in tight contact with each other in each pair.

In the above description, it is defined and illustrated that two electric wires are connected to each other by the electric wire connector according to the present invention. Alternatively, it is possible to connect electric wires having a ratio of 1:N or N:M, and the structure of the electric wire connector according to the present invention may be variously modified accordingly.

As is apparent from the above description, the present invention has the effect of achieving connection between electric wires without using an additional tool and simultaneously connecting a plurality of electric wires, which is very economic. Also, the electric wire connector according to the present invention includes the inner conductive member and outer insulative member, and therefore, the present invention has the effect of achieving easy and simple assembly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electric wire connector comprising:

an insulative lower connector formed in a shape extending in a first direction, the lower connector being open at a top thereof, the lower connector being provided at a bottom thereof with a plurality of fixing protrusions protruding upward, the lower connector being provided at sides thereof with shaft support parts, the lower connector being provided at front and rear ends thereof in a longitudinal direction thereof with support grooves through which electric wires are inserted, the electric wires being supported by the support grooves;

an insulative upper connector formed in a shape extending in the first direction, the upper connector being open at a bottom thereof, the upper connector being provided at sides thereof with fixing holes into which the fixing protrusions of the lower connector are inserted and a fixing shaft inserted through the shaft support parts of the lower connector, the upper connector being provided at front and rear ends thereof in a longitudinal direction thereof with support grooves through which electric wires are inserted, the electric wires being supported by the support grooves, the upper connector covering the lower connector; and a conductive member disposed in the lower connector, the conductive member having a plurality of cutting blades for peeling off sheaths of the electric wires, the cutting blades being electrically connected to cores of the electric wires, wherein the upper connector is provided at a middle of a bottom thereof with a fixing piece for pressing the conductive member to fix the conductive member.

* * * * *